United States Patent [19]

Berg et al.

[11] Patent Number: 4,463,987

[45] Date of Patent: Aug. 7, 1984

[54] SYSTEM FOR UNDERSEA RECOVERY OF HYDROCARBONS

[75] Inventors: Terie Berg, Asker; Trond Hübertz, Drammen; Erland Kleiven; Ivar Torblaa, both of Oslo, all of Norway

[73] Assignees: Ingeniør A.B. Berdal A/S, Sandvika; Ingeniør Thor Furuholmen A/S, Oslo; Sivilingeniør Nybro Hansen A/S, Høvik, all of Norway

[21] Appl. No.: 288,914

[22] Filed: Jul. 31, 1981

Related U.S. Application Data

[63] Continuation of Ser. No. 93,038, Nov. 9, 1979, abandoned.

[30] Foreign Application Priority Data

Nov. 14, 1978 [NO] Norway ..... 783815

[51] Int. Cl.[3] ..... E21B 7/12

[52] U.S. Cl. ..... 299/2; 166/364; 166/50

[58] Field of Search ..... 299/2; 175/5, 6; 166/363, 364, 50

[56] References Cited

U.S. PATENT DOCUMENTS

| | | | |
|---|---|---|---|
| 2,331,072 | 10/1943 | Hansen et al. | 299/2 |
| 2,850,271 | 9/1958 | Dykstra | 299/2 |
| 2,989,294 | 6/1961 | Coke | 299/2 |

*Primary Examiner*—William F. Pate, III

*Attorney, Agent, or Firm*—Watson, Cole, Grindle & Watson

[57] ABSTRACT

The invention relates to an undersea system for the recovery of hydrocarbons, comprising at least one tunnel (13) extending from a terminal ashore to at least one chamber (1) adapted to accommodate drilling and other hydrocarbon recovery apparatus (3, 4).

For the purpose of reducing or preventing damage due to a blowout or the like in such a chamber (1) with adhering tunnel or tunnels (13), the system according to the invention comprises in addition to the chamber (1) and tunnel or tunnels (13), at least one further chamber (6) which is adapted to receive and temporarily store hydrocarbons which unintentionally might appear in the first chamber (1) and to emit gaseous or liquid and/or solid hydrocarbon constituents through a tunnel (8) and/or pipe (7) for disposal and/or processing.

4 Claims, 3 Drawing Figures

SYSTEM FOR UNDERSEA RECOVERY OF HYDROCARBONS

This application is a continuation application of application Ser. No. 093,038, filed Nov. 9, 1979, now abandoned.

BACKGROUND OF THE INVENTION

In systems for the undersea recovery of oil, it is usual practice to use floating, tower-like structures to conduct drilling necessary to establish the existance of exploitable deposits of hydrocarbons and then to use stationary structures located between the sea bed and the sea surface to achieve the actual hydrocarbon recovery. Such structures, whether they be floating or stationary, entail a series of inconveniencies and perils. The structures are subjected to weather, wind and sea currents, and the transport of crews and materials must be effected on or above the surface of the sea. In addition, the transport of produced hydrocarbons must be effected by means of pipelines or floating loading buoys, thus involving danger of leakages and structural difficulties. It is also essential that any blowout occur in open air such that the flowing of liquid hydrocarbon will accumulate on the sea surface, thereby exposing it to possible ignition which, once started, is very difficult to control.

For the purpose of avoiding the inconveniencies and perils indicated, it has been suggested to arrange drilling and the associated apparatus for developing oil fields in a chamber which is excavated in the sea bed and which communicates with an ashore terminal through a horizontal tunnel. For the purpose of avoiding the occurrence of a blowout, with the inherent dangers to the crew operating the apparatus in the under-sea system, it has been suggested to arrange a separate chamber below the operation chamber accommodating safety valves, tubes and pumps in a distinct drilling mud system, which is to be initiated at the occurrence of such a pipe breakdown which might lead to a blowout. However, such systems are scarcely practicable, partly due to the large quantity of apparatus involved and partly due to the fact that the security obtained is rather restricted, substantially to simple pipe fractures, while other risks of fatal situations are still present.

The present invention is based on a different conception, aiming at a system wherein the damaging effects of a blowout or other accidents which might occur in a submarine drilling and oil recovery system are restricted, i.e., such that escaping hydrocarbons are immediately taken care of and disposed of.

SUMMARY OF THE INVENTION

According to the invention such purpose is fulfilled by the arrangement, in communication with a chamber excavated in the sea bed and adapted to accommodate drilling and oil recovery apparatus, of at least one further chamber adapted to receive and temporarily store gaseous liquid and/or, solid constituents of hydrocarbons which unintentionally might be present in the first-mentioned chamber and to emit the same through tunnels and/or pipes to desired suitable disposal or processing means, such as to the ordinary output lines of the system.

Thus, the second chamber will act as a buffer wherein the pressure of the incoming hydrocarbons is relieved and from which hydrocarbons originating from a blowout or other accident may be disposed of, and wherein further separation of gaseous and liquid hydrocarbons may be effected.

As in the previously suggested under-sea systems, the system according to the invention may communicate with one or more terminals ashore through tunnels, so that all transport of men, materials and recovered hydrocarbon may be performed in a protected fashion through tunnels. Any possible blowout will occur in the first-mentioned chamber, so that the quantity of oxygen available to a fire is highly restricted, and hydrocarbons emitted will escape through the tunnel to the relief chamber, from which the gas and liquid are carried away separately, and possibly utilized. Further features of the invention and the advantages they bring will appear from the following description taken together with the accompanying drawings which illustrate an example of how a system according to the invention may be constructed.

DETAILED DESCRIPTION OF THE PREFERRED EMBODIMENT

Figure 1:
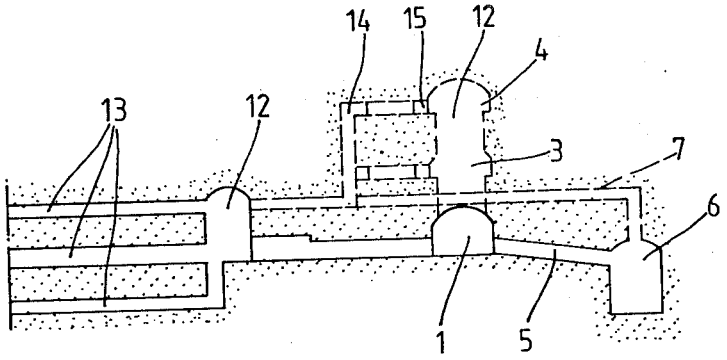
FIG. 1 is a vertical sectional view of the system, taken along the line c—c in FIG. 2.

As shown in the drawings, a chamber 1 is excavated below the sea bed, with its peak point at a good distance, such as 100 meters, from the rock surface, at a place where a workable hydrocarbon deposit has been located. The chamber 1 is adapted to accommodate equipment at the well head or heads, manifolds for the same and other equipment required in connection with the production.

Figure 2:
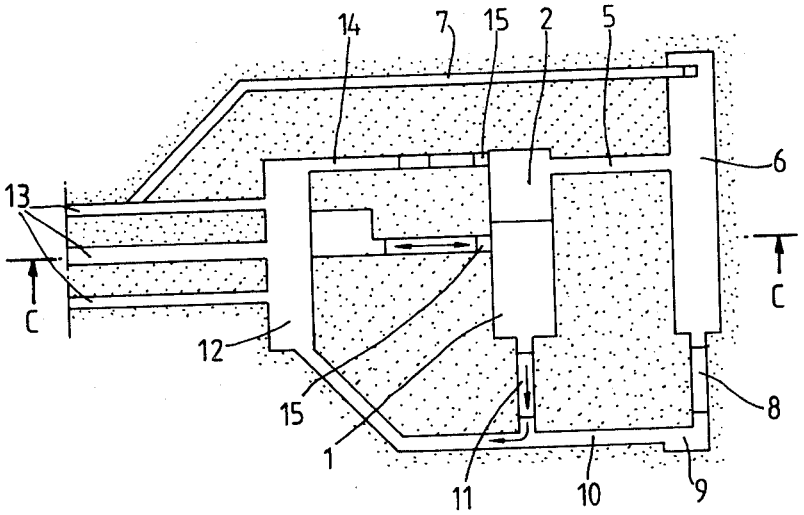
FIG. 2 is a horizontal sectional view of the system.
Figure 3:
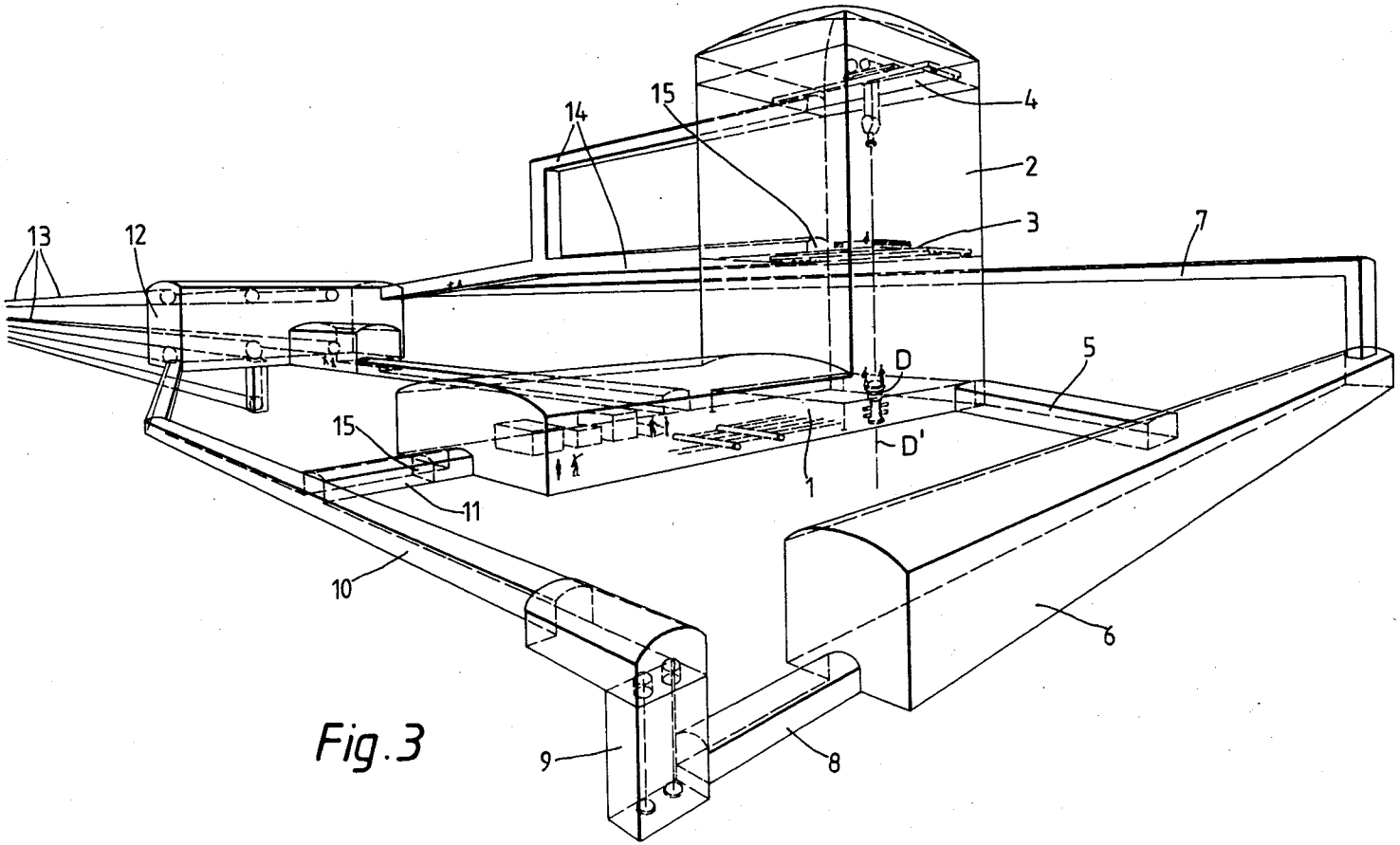
FIG. 3 is a perspective view of the system, showing the essential parts of the same.

As shown in FIGS. 2 and 3, the chamber 1 includes a horizontal portion and a vertical (shaft) portion 2 so as to provide room for the drilling equipment for the drilling of recovery wells. Such equipment may be mounted in bridge structures as indicated at 3 and 4 in FIG. 3. The drilling equipment will include a drilling conduit D' which will, as indicated in FIG. 3, extend generally downwardly towards the hydrocarbon deposit.

At or near to the floor of the chamber 1, a tunnel 5 is excavated which leads into a lower situated second chamber 6 which is adapted to receive flooding hydrocarbons from a blowout occurring at a well head, and to permit further separation of the hydrocarbons into a gaseous and a liquid phase. The gas is freely removed through a tunnel or pipe 7 into the atmosphere or to processing apparatus, while the liquid phase is emitted through a tunnel or pipe 8 to a pump chamber 9 having an outlet 10 which communicates with the ordinary outlet 11 of the system and further to a manifold 12 and tunnel 13 to apparatus for the refinement of well products.

Communicating with the chamber 1 and the shaft portion 2 are escape tunnels 14 located at different levels, the tunnel 11 being also adapted to serve as an escape tunnel so that crews operating in the chamber or shaft portion may escape in case of an accident in the recovery apparatus. The tunnels mentioned and the pump chamber 9 are provided with pressure-safe blocking devices 15 so that the chamber 1 and the shaft portion 2 and the second chamber 6 may be completely shut off. Consequently, during a blowout, a possible ignition of gas emitted into the chamber 1 from a well head is self-extinguishing because the oxygen of the air in the closed-up chamber 1 with its shaft portion 2 is consumed. The gas-liquid mixture which is then emitted by the well head will flow into the chamber 6, so that the chamber will become accessible to the crew desiring to plug the well.

In addition to the tunnels mentioned above, enough suitably equipped tunnels or pipes 13 extend ashore from the manifold 12 so as to satisfy the demand for transport of hydrocarbons, crews, accessories, air and cooling water for the operation of the systems.

Even if the drawings illustrate a system having one one drill chamber 1, one discharge chamber 6 and one manifold 12, it is obvious that a system according to the invention may be constructed with a plurality of such means arranged in various combinations. It is also possible to make the chamber 6 communicate directly with or be part of the chamber 1, the tunnel 8 being positioned at the floor of the chamber 1, and the tunnel 7 connected to the top of the chamber 1. The construction to be chosen is dependent of the extension of the deposit, so that the consequence of a possible blowout in a well head be restricted in the best possible manner.

We claim:

1. A system for the undersea recovery of hydrocarbons which comprises a first underground chamber located below the seabed which is sufficiently large to house hydrocarbon development apparatus and to allow for operation thereof by attendant personnel, hydrocarbon development apparatus located in said first underground chamber, said hydrocarbon development apparatus being connected to a hydrocarbon tapping circuit extending generally downwardly from the first underground chamber toward an undersea hydrocarbon deposit, a second underground chamber located near said first underground chamber and away from said hydrocarbon tapping conduit, said second underground chamber having an elongated shape and being generally horizontally oriented, said second underground chamber having opposite ends and top and bottom walls, a conduit means connected between said first underground chamber and said second underground chamber between its opposite ends so as to cause any hydrocarbons accumulating in said first underground chamber to be drained into said second underground chamber, a first outlet means connected to the top wall of said second underground chamber near a first of its opposite ends to vent hydrocarbon gases accumulated in said second underground chamber, and a second outlet means connected to the bottom wall of said second underground chamber near a second of its opposite ends to drain hydrocarbon liquids accumulated in said second underground chamber.

2. A system as defined in claim 1 wherein said hydrocarbon development apparatus consists of hydrocarbon drilling equipment.

3. A system as defined in claim 1 wherein said second underground chamber is located below and to the side of said first underground chamber.

4. A system as defined in claim 1 wherein said first underground chamber includes a horizontal portion and a vertical portion, and wherein said hydrocarbon drilling apparatus is located in its vertical portion.

* * * * *